US006842911B2

(12) United States Patent
Yeh

(10) Patent No.: US 6,842,911 B2
(45) Date of Patent: Jan. 18, 2005

(54) FOLDABLE FORMATIVE CAP CAPABLE OF OPENING AUTOMATICALLY

(76) Inventor: Chia-Ching Yeh, 3F, No. 2, Ln. 155, Pa-Te Rd., Sec. 3, Taipei (TW)

( * ) Notice: Subject to any disclaimer, the term of this patent is extended or adjusted under 35 U.S.C. 154(b) by 71 days.

(21) Appl. No.: 10/154,806

(22) Filed: May 28, 2002

(65) Prior Publication Data

US 2003/0221242 A1 Dec. 4, 2003

(51) Int. Cl.[7] ..... A42B 1/00
(52) U.S. Cl. ..... 2/171.02; 2/209.13
(58) Field of Search ..... 2/171, 174, 182.6, 2/182.1, DIG. 11, 209.13; 132/273, 275

(56) References Cited

U.S. PATENT DOCUMENTS 3,234,563 A * 2/1966 Tabbat ..... 2/67
3,345,646 A * 10/1967 McCann ..... 2/171
4,447,250 A * 5/1984 Wolens et al. ..... 446/27
6,047,709 A * 4/2000 Tu ..... 132/275
6,256,796 B1 * 7/2001 Fleming ..... 2/209.13
6,453,475 B1 * 9/2002 Johnson ..... 2/209.11

* cited by examiner

*Primary Examiner*—Katherine Moran
(74) *Attorney, Agent, or Firm*—Troxell Law Offices PLLC

(57) ABSTRACT

A foldable formative cap capable of opening automatically, which is mainly comprised of a cap body and a hair hoop. Wherein, two sides of the cap body have folding lines and can be folded, and there is a supporting seat arranged in each left and right side of the top face of the hair hoop additionally, and the upper portion of the supporting seat is connected and secured at an appropriate position of the folding lines at the two sides of the cap body by the means of a fixing structure. By the aforementioned structure, when a user props up the hair hoop with hand, the upper portion of the supporting seat located on the hair hoop will be closed and tilted toward the center gradually, and the distance between the folding lines at the left and the right two sides of the cap body is in turn closed near, and the cap body oy origi showed as a folding shape can be opened automatically and shown as a three-dimensional shape, and in the meantime, in cooperation with the cut groove arranged on the cap body, the user may insert and fix any different characters or patterns. Not only can it facilitate the user to design or choose any pattern or character by a DIY manner to quickly assemble more interesting variations, but also does it have the advantages of foldable storage, less occupying space, better wearing and fixing effects, and further fulfilling the object of practical application.

18 Claims, 10 Drawing Sheets

FOLDABLE FORMATIVE CAP CAPABLE OF OPENING AUTOMATICALLY

FIELD OF THE INVENTION

The invention relates to a foldable formative cap capable of opening automatically, especially to such a kind of cap that can be stored up easily, and be opened up automatically and shown as a three-dimensional shape after being worn on the head.

BACKGROUND OF THE INVENTION

Accordingly, in many western festivals or family gatherings, no matter for adults or children, they usually wear a formative cap A shaped as a cone (as shown in FIG. 1), of which most part is made of material of smooth-face paper or thin-type plastic, in the meantime, and of which two sides are tied by an elastic rope B, such that the user may band the elastic loop B under his chin to reach the purpose of fixing the formative cap A. However, there are still many shortcomings in the aforementioned structure in practical application to make the user feel very inconvenient. First, in the traditional formative cap A is uneasy to be fixed under the chin and near the neck and, since only one elastic lope B is restrained under the chin and near the neck of the user according to the prior arts, so it will cause the user felt uncomfortable if it is tightened too much. But, if the elastic lope B is unable to be tightened under the chin of the user, it will cause the formative cap A worn on the user's head to be loose off because of the shaking and displacement generated by the user during the jumping or dancing of the revelry. On the other hand, since the formative cap A is structurally designed as a cone shape, so the storage is a big problem after being used. Because it is a cap body shaped as a cone and made of the material of smooth-face paper and thin-shape plastic, as soon as it is incurred extrusion, a serious deformation will be generated and even be broken or damaged. Therefore, its unfoldable characteristic would cause inconvenience in storage. In addition, the structure according to prior arts is not only simple, but also is lack of variation in shape. It is impossible to make special shape variation according to special festival, and in turn it is impossible to increase the willingness of the user to wear such kind of cap, such that it causes the user extreme inconvenience and harassment.

Therefore, from above description, it is apparently known that the formative cap according to prior arts is not only unfoldable, but also occupies too large space, and its structure is too simple and lack of flexibility and variation, such that it is impossible to secure on the head of the user firmly and it is easy to be loose off. All these problems are waited urgently to be studied and solved by us.

In order to solve the aforementioned shortcomings of the connection device of the assembling frame according to prior arts, the inventor, through many years of manufacturing experience and devotional study engaged in such kind of product and through the continuation of hard-working research, experimental analysis and improvement, has finally proposed an invention with reasonable design and capable of solving the shortcomings of the prior arts.

SUMMARY OF THE INVENTION

The main object of the invention is to provide a foldable formative cap capable of opening automatically, which is mainly comprised of a cap body and a hair hoop. Wherein, two sides of the cap body have folding lines and can be folded, and there is a supporting seat arranged in each left and right side of the top face of the hair hoop additionally, and the upper portion of the supporting seat is connected and secured at an appropriate position of the folding lines at the two sides of the cap body by the means of a fixing structure. By the aforementioned structure, when a user props up the hair hoop with hand, the upper portion of the supporting seat located on the hair hoop will be closed and tilted toward the center gradually, and the distance between the folding lines at the left and the right two sides of the cap body is in turn pulled closer, and the cap body originally showed as a folding shape can be opened automatically and shown as a three-dimensional shape, such that it has the advantages of foldable storage, less occupying space, and further fulfilling the object of practical application.

The secondary object of the invention is to provide a foldable formative cap capable of opening automatically, wherein, since the invention applies a hair hoop to be fixed on the head of a user, so the invention can thereby obtain a better effect of fixation by comparing with the traditional manner that applies an elastic rope.

Another object of the invention is to provide a foldable formative cap capable of opening automatically, wherein there is a post arranged at the center of the top face of the hair hoop, and an elastic element is arranged at the upper portion of the post and, in the mean time, in cooperation with top end of the cap body, an opening is arranged. Several decoration objects may be arranged on the elastic element to make the aforementioned elastic element and the decoration objects thereon be able to extend through the opening arranged on the cap body and shake along with the displacement of the body of the user.

A further object of the invention is to provide a foldable formative cap capable of opening automatically, wherein, there are several cut grooves arranged on the cap body, such that the user can directly insert various patterns or characters therein or apply a clipping device to fix them on the cap body, such that the invention has multiple variations of formation and its outer appearance may also be dominated and designed by the user himself completely.

For your esteemed members of reviewing committee to further understand and recognize the structural object and function of the invention, a detailed description in cooperation with corresponding drawings are presented as follows.

DETAILED DESCRIPTION OF THE INVENTION

Figure 1:
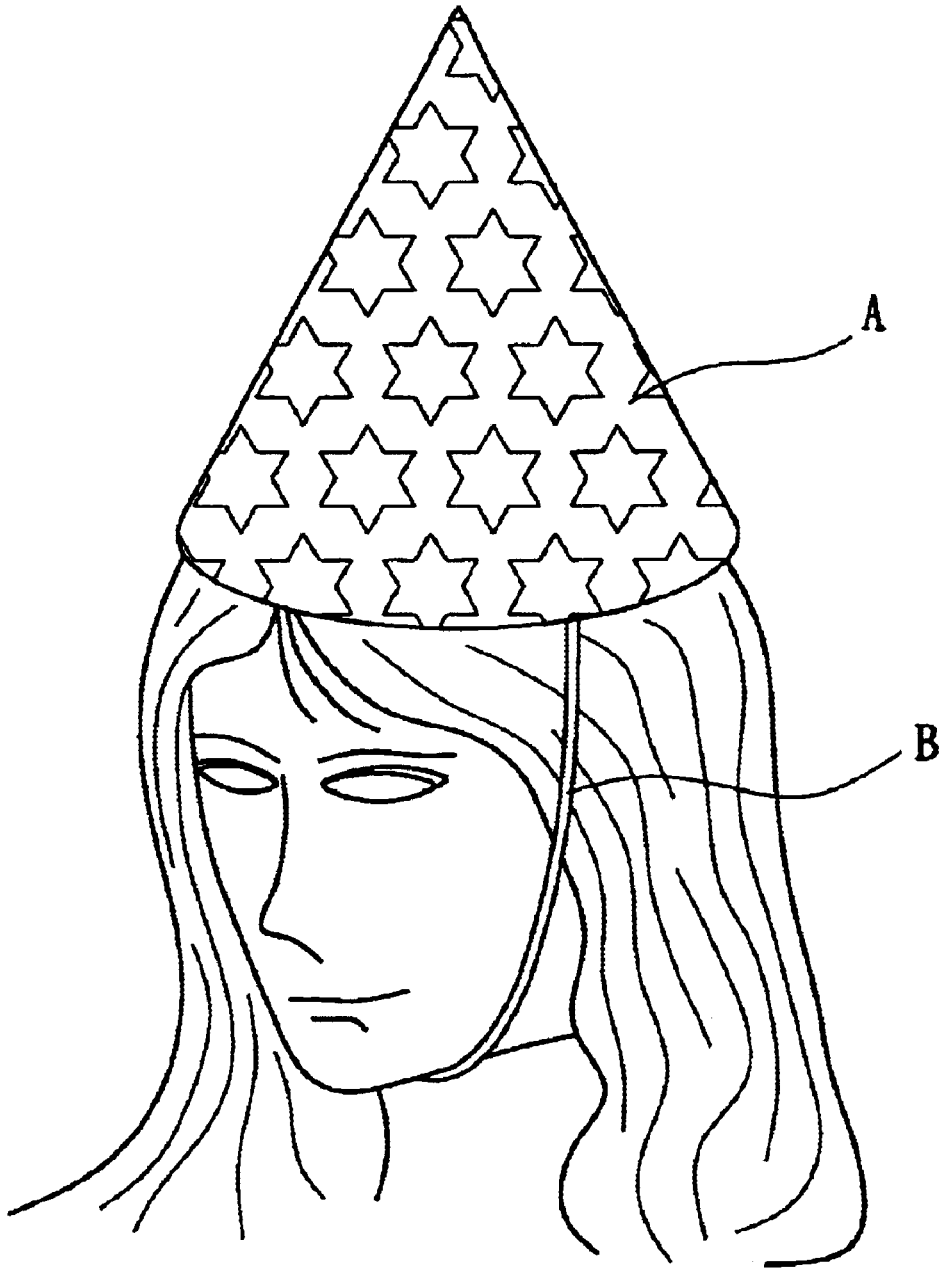
FIG. 1 (PRIOR ART)
FIG. 1 is an illustration for the structure according to the prior arts.
Figure 2:
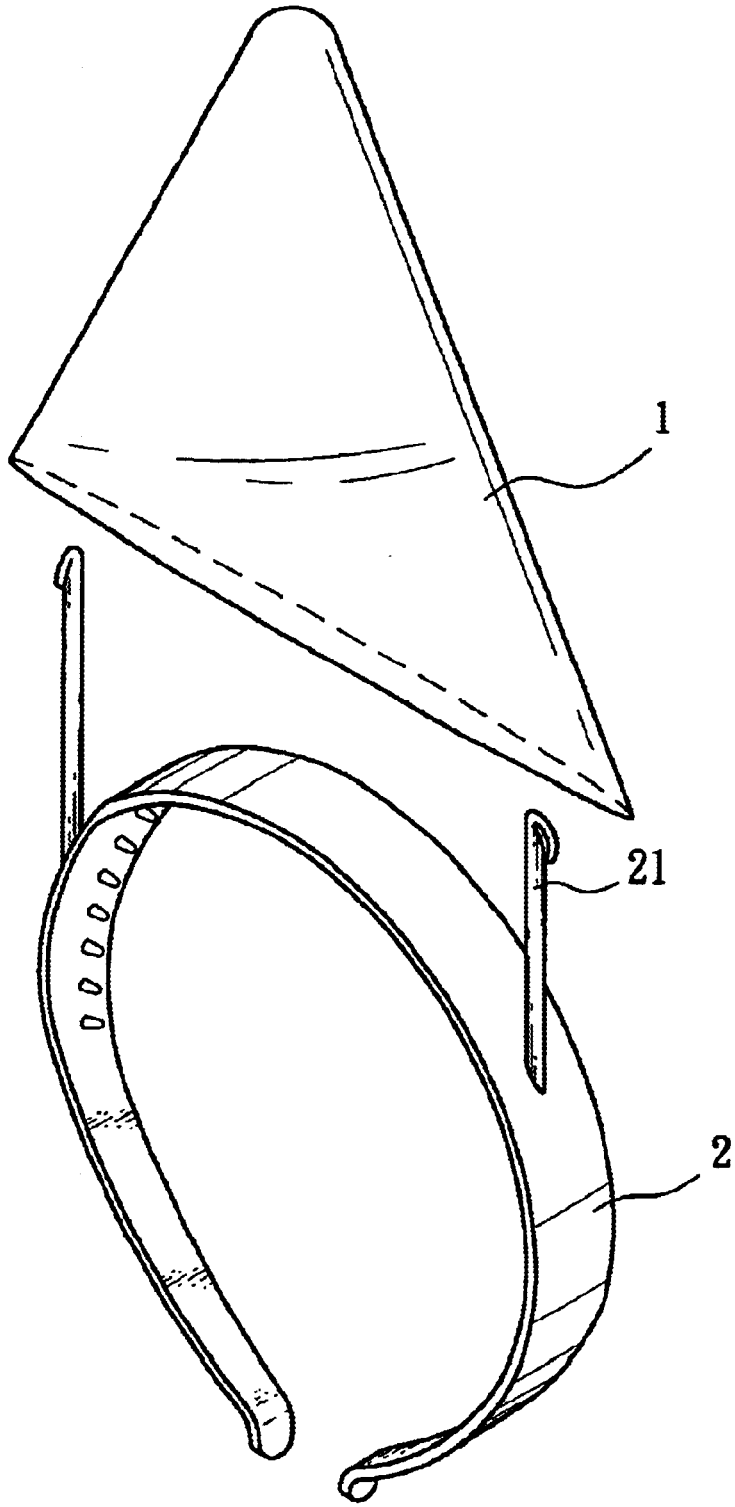
FIG. 2 is a three-dimensional explosive view of the present invention.
Figure 3:
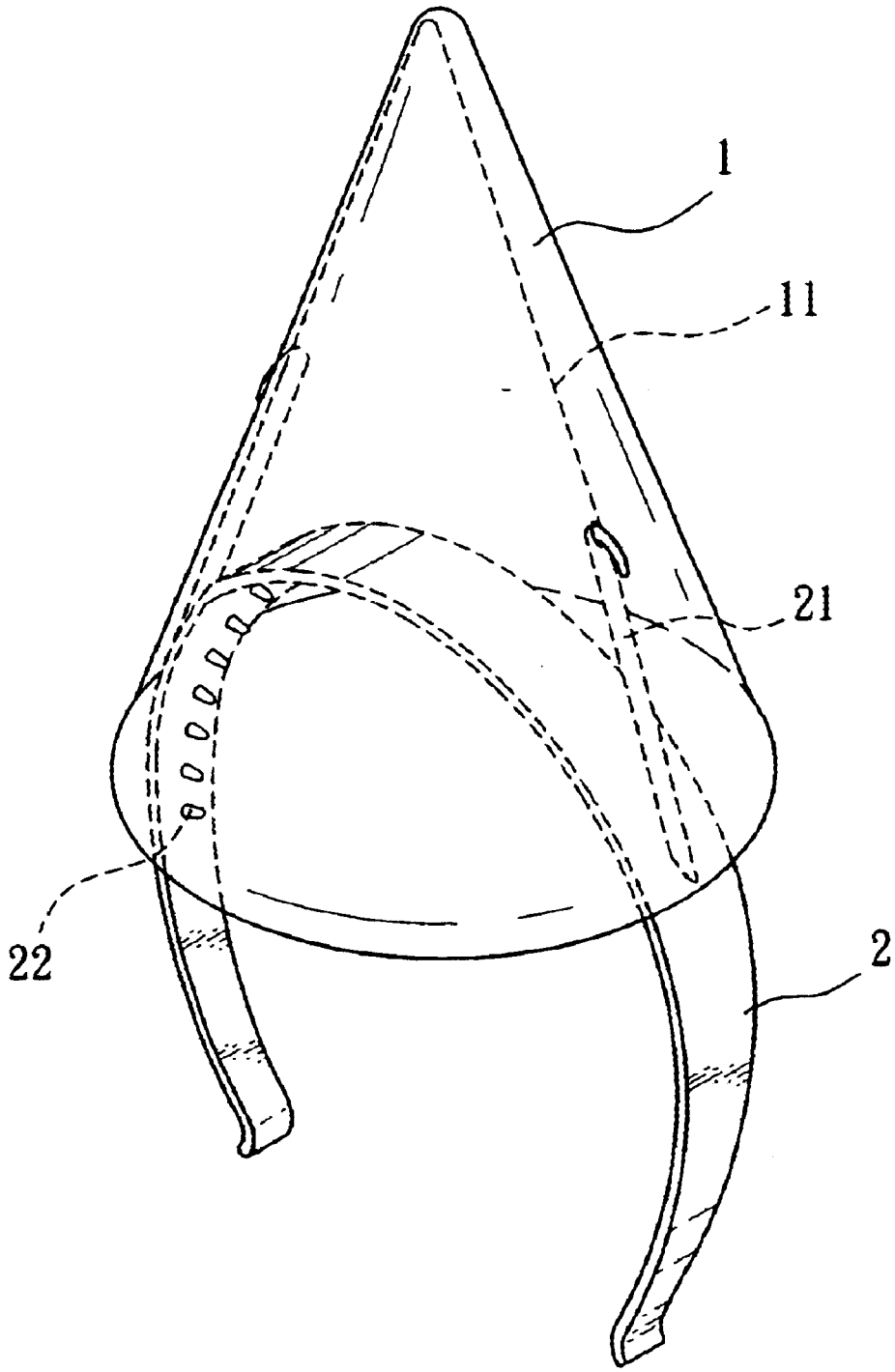
FIG. 3 is a three-dimensional assembling view of the present invention.

First, please refer to FIG. 2 and FIG. 3, which are respectively the three-dimensional explosive view and the three-dimensional assembling view for the foldable formative cap capable of opening automatically according to the present invention. The foldable formative cap capable of opening automatically disclosed by the present invention is mainly comprised of a cap body 1 and a hair hoop 2. Wherein, two sides of the cap body 1 have folding lines 11 and can be folded, and there is a supporting seat 21 arranged in each left and right side of the top face of the hair hoop 2 additionally, and the upper portion of the supporting seat 21 is connected and secured at an appropriate position of the folding lines 11 at the two sides of the cap body 1 by the means of a fixing structure. By the aforementioned structure, when a user props up the hair hoop 2 with hand, the upper portion of the supporting seat 21 located at the left and right two sides of the hair hoop 2 will be closed and tilted toward the center gradually, and the distance between the folding lines 11 at the left and the right two sides of the cap body is in turn pulled closer, and the cap body 1 originally showed as a folding shape can be opened automatically and shown as a three-dimensional shape, such that it has the advantages of foldable storage, less occupying space, and further fulfilling the object of practical application.

Figure 4D:
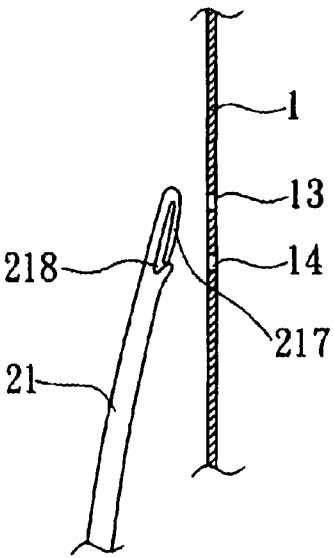
FIG. 4A to FIG. 4G are different kinds of implementing views for the fixing structure between the upper portion of the supporting seat and the cap body of the invention.
Figure 4C:
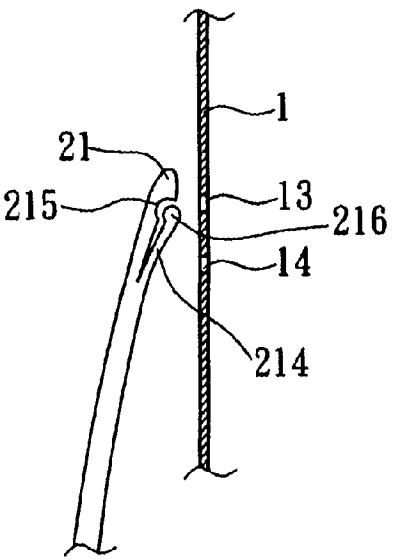

In the structure described in above section, there are plural convex points 22 arranged at the inner face of the hair hoop 2, such that it may have better fixing effect between the hair hoop 2 and the hair of the user. In addition, the fixing structure applied for fixing the upper portion of the fixing seat 21 and the cap body 1 can be achieved by means of different kinds of buckling-up structures, such as the following preferable embodiments that are presented in cooperation with corresponding drawings (please refer to FIG. 4A through FIG. 4G). First, please refer to FIG. 4A, which is mainly a reverse hook 211 that is arranged at the top end of the supporting seat 21 and is bent outwardly and reversely. In the meantime, in cooperation with the corresponding position on the cap body 1, a fixing hole 12 is arranged for the reverse hook 211 to pass through, such that the reverse hook 211 at the upper portion of the supporting seat 21 can be passed through the fixing hole 12 on the inner face of the cap body 1 and be pulled downward, such that the purpose of the connection and the fixation with the cap body 1 is reached.

Figure 4B:
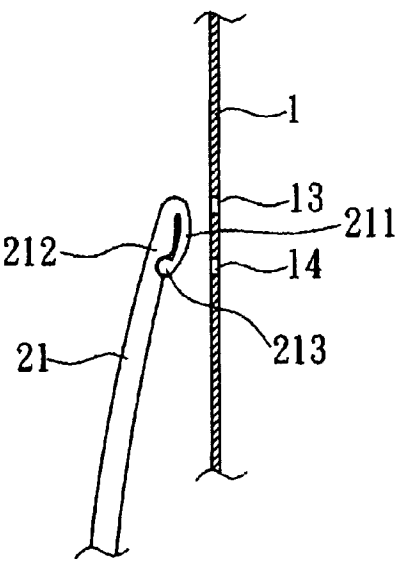
Figure 4A:
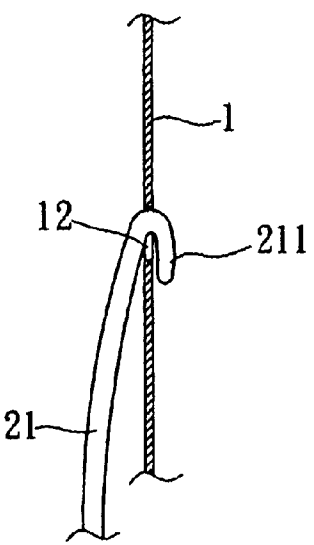
Figure 4G:
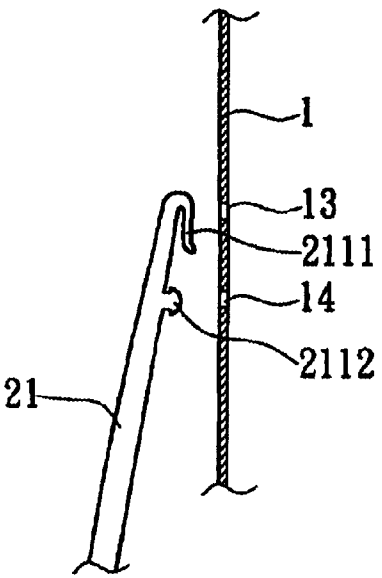

Continuously, please refer to FIG. 4B, which is mainly a reverse hook 211 that is arranged at the top end of the supporting seat 21 and is bent outwardly and reversely. A recessing edge 212 and a protruding part 213 are arranged respectively at the upper portion of the supporting seat 21 and the adjacent face of the tail end of the reverse hook 211. In the meantime, in cooperation with the corresponding positions on the cap body 1, a first fixing hole 13 is arranged for the reverse hook 211 to pass through, and a second fixing hole 14 is arranged for the protruding part 213 to pass through, such that the reverse hook 211 at the upper portion of the supporting seat 21 can be passed through the first fixing hole 13 on the inner face of the cap body 1 and be pulled down to reach a fixed position, and then the protruding part 213 on the reverse hook 211 can be passed through the second fixing hole 14, such that the purpose of the connection and the fixation with the cap body 1 is reached.

Again, please refer to FIG. 4C, which is mainly a clipping part 214 that is arranged at the upper portion of the supporting seat 21 and is crotched and extended outwardly. A snapping-in recessing edge 215 and a protruding part 216 are arranged respectively at the upper portion of the connecting seat 21 and the adjacent face of the tail end of the clipping part 214. In the meantime, in cooperation with the corresponding positions on the cap body 1, a second fixing hole 14 is arranged for the clipping part 214 to pass through, and a first fixing hole 13 is arranged for the protruding part 216 to pass through, such that the clipping part 214 at the upper portion of the supporting seat 21 may be passed through the second fixing hole 14 on the inner face of the cap body 1 to reach a fixed position, and the protruding part 216 arranged on the clipping part 214 is then pressed down, passed through the first fixing hole 13, and buckled up securely together with the snapping-in recessing edge 215 arranged at the upper portion of the supporting seat 21, such that the purpose of the connection and the fixation with the cap body 1 is reached.

Further, please refer to FIG. 4D, which is mainly a clipping part 217 that is arranged t the upper portion of the supporting seat 21 and is bent reversely and outwardly. A snapping-in recessing edge 218 is arranged on the supporting seat 21 at the position corresponding to the tail end of the clipping part 217. In the meantime, in cooperation with the corresponding position on the cap body 1, a first fixing hole 13 and a second fixing hole 14 are arranged for the clipping part 217 to pass through, such that the clipping part 217 at the upper portion of the supporting seat 21 can be passed through the first fixing hole 13 on the inner face of the cap body 1 to reach a fixed position, and the tail end of the clipping part 217 is pressed down, passed through the second fixing hole 14, and buckled up securely together with the snapping-in recessing edge 218 arranged at the upper portion of the supporting seat 21, such that the purpose of the connection and the fixation with the cap body 1 is reached.

Figure 4F:
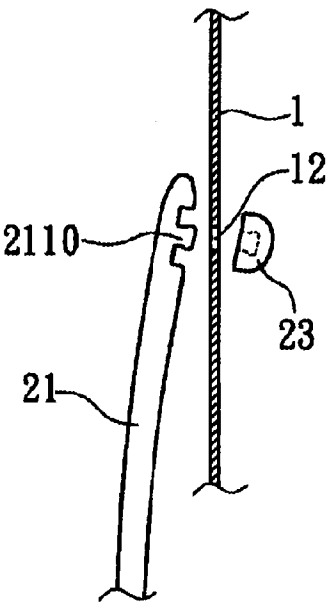
Figure 4E:
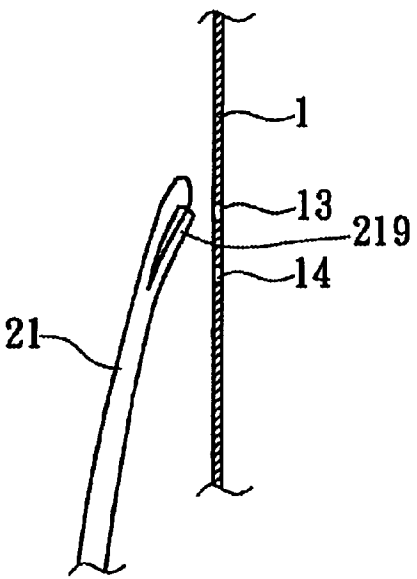

Furthermore, please refer to FIG. 4E, which is mainly a clipping part 219 that is arranged at an appropriate position at the upper portion of the supporting seat 21 and is crotched outwardly. In the meantime, in cooperation with the corresponding position on the cap body 1, a first fixing hole 13 is arranged for the top end of the supporting seat to pass through and a second fixing hole 14 is arranged for the clipping part 219 to pass through, such that the clipping part 219 at the upper portion of the clipping seat 21 can be passed through the second fixing hole 14 on the inner face of the cap body 1 and be pushed upwardly to reach a fixed position, and the top end of the supporting seat 21 is then made to pass through the first fixing hole 13, such that the purpose of the connection and the fixation with the cap body 1 is reached.

Continuously, please refer to FIG. 4F, which is mainly a protruding part 2110 that is arranged at the outer side at an appropriate position at the upper portion of the supporting seat 21. In the meantime, in cooperation with an appropriate position on the cap body 1, a fixing hole 12 is arranged for the protruding part 2110 to pass through, such that the protruding part 2110 at the upper portion of the supporting seat 21 can be passed through the fixing hole 12 on the inner face of the cap body 1, and a buckling-up block 23 is applied to be buckled up securely together with the protruding part 2110, such that the purpose of the connection and the fixation with the cap body 1 is reached.

Again, please refer to FIG. 4G, which is mainly a clipping part 2111 that is arranged at the top end of the supporting seat 21 and is bent outwardly and reversely. In addition, a buckling-up part 2112 is arranged at an appropriate position at the lower portion of clipping part 2111 located on the supporting seat 21. In the meantime, in cooperation with the corresponding positions on the cap body 1, a first fixing hole 13 is arranged for the clipping part 2111 to pass through and a second fixing hole 14 is arranged for the buckling-up part 2112 to pass through, such that the clipping part 2111 at the upper portion of the supporting seat 21 can be passed through the first fixing hole 13 on the inner face of the cap body 1, pulled downwardly, and then reached to a fixed position, and the buckling-up part 2112 arranged on the supporting seat is made to be passed from inside to outside through the second fixing hole 14 arranged on the cap body 1, such that the purpose of the connection and the fixation with the cap body 1 is reached.

Figure 5A:
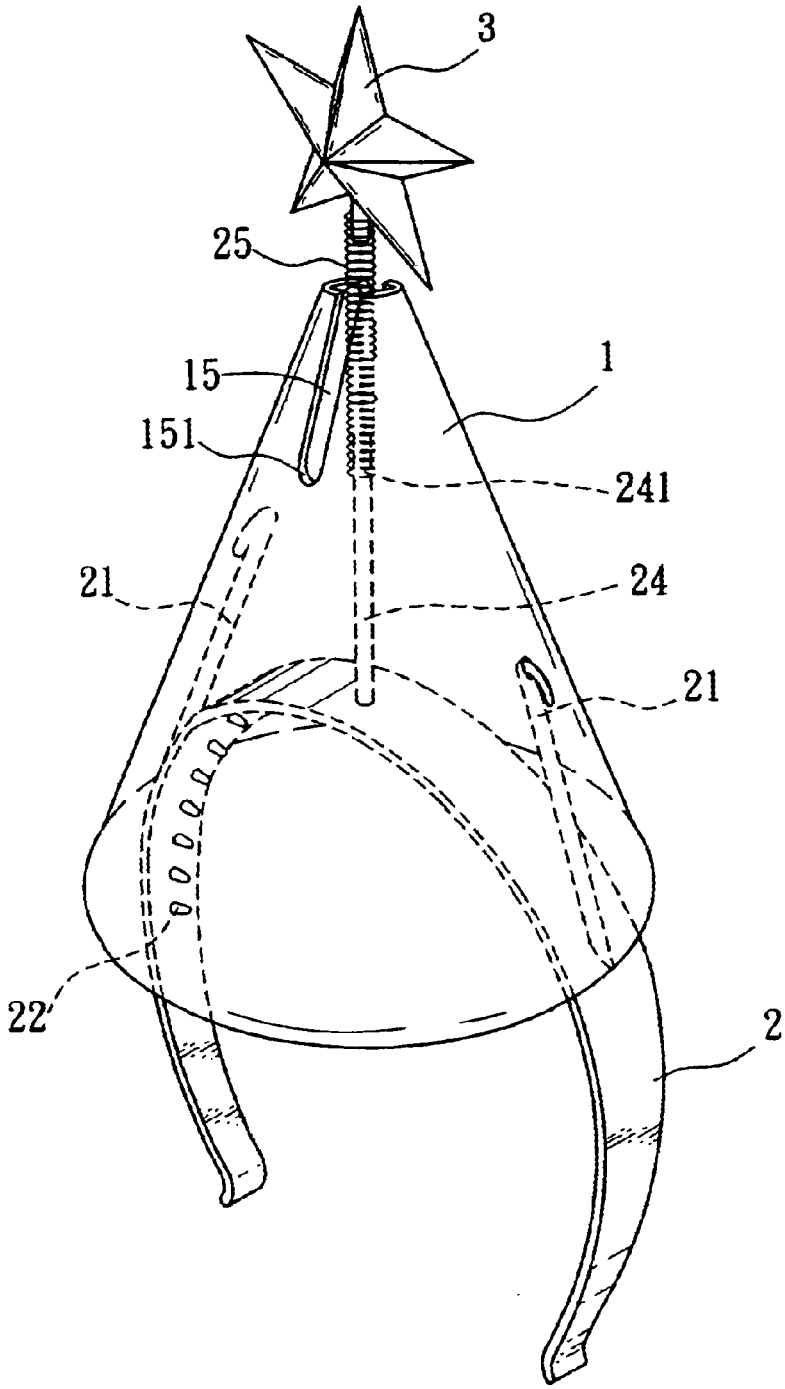
FIG. 5A to FIG. 5C are the implementing views respectively for the different shapes of cut grooves arranged in cooperation with the opening on the top end and for the post arranged additionally for the invention.
Figure 5B:
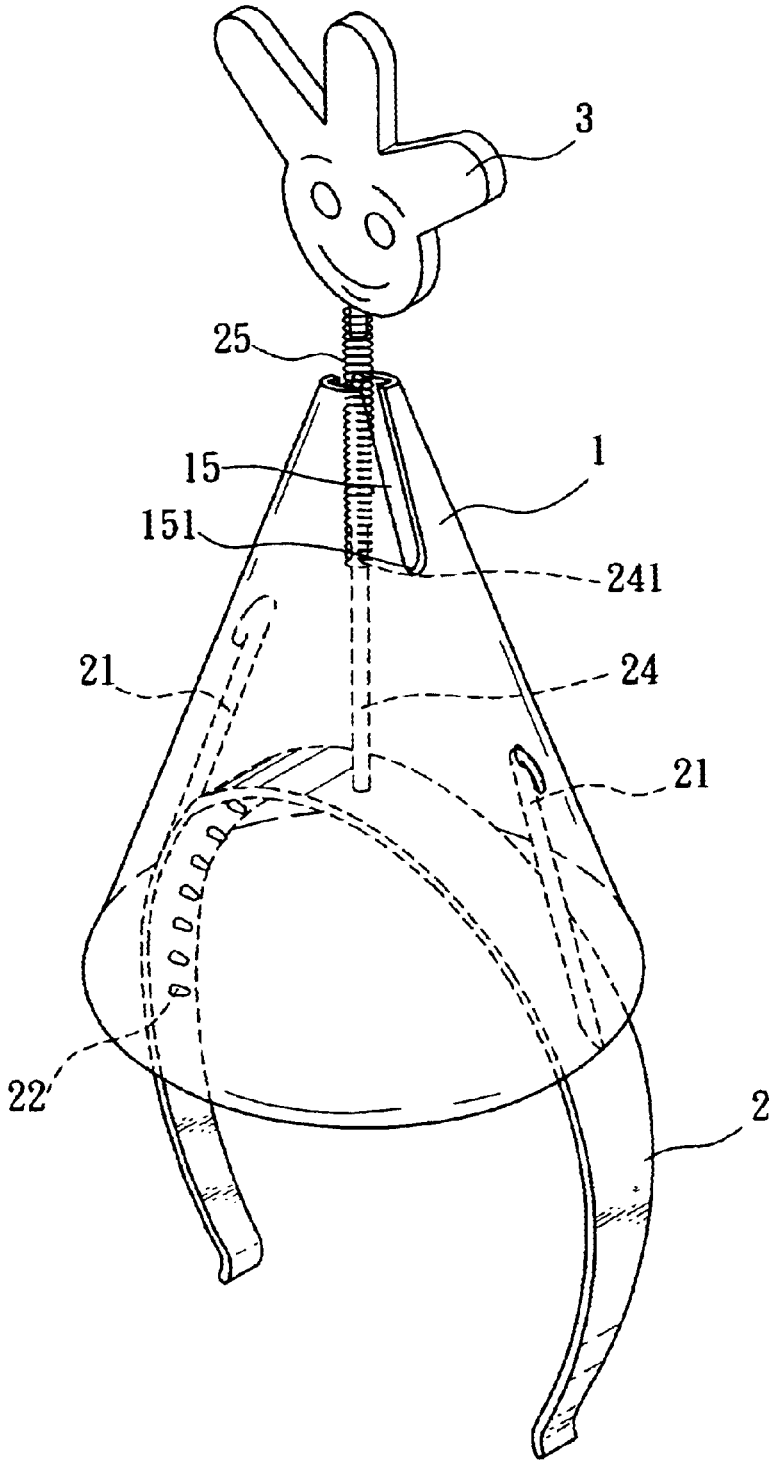

Again, in the structure of the invention, a post 24 is further arranged at the center of the top face of the hair hoop 2, and an elastic element 25 is arranged at the upper portion of the post 24. In the meantime, an opening 15 is arranged in cooperation with the top end of the cap body 1. Various decoration objects 3 can be arranged on the elastic element 25 (as shown in FIG. 5A). Therefore, said elastic element 25 and the decoration objects 3 thereon can be extended through the opening 15 arranged on the cap body 1 and be shaken along with the displacement of the body of the user.

Figure 5C:
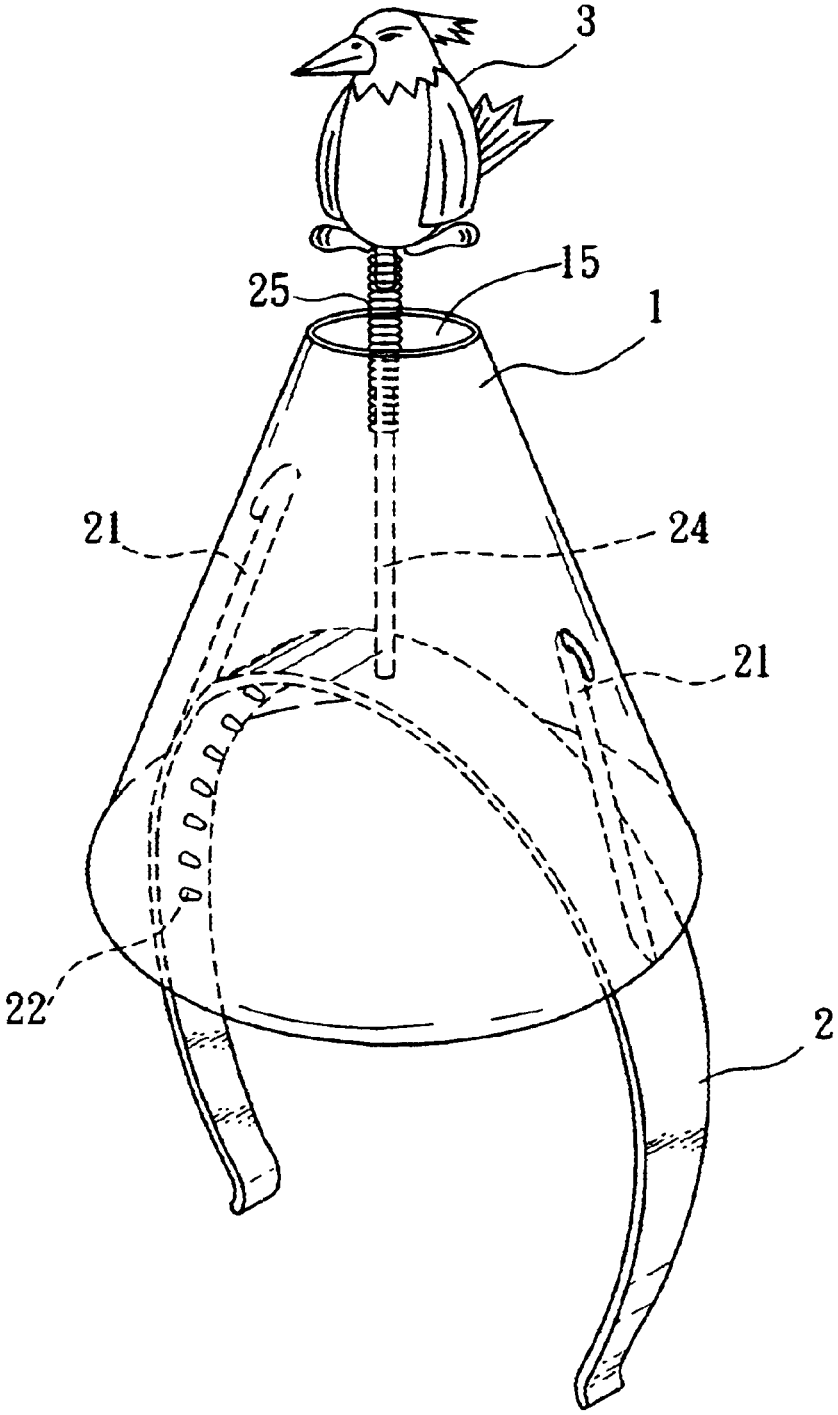

In the structure mentioned in above section, the elastic element 25 is a spring. In addition, the fixation manner for the spring 25 and the post 24 is mainly at least one round of flange 241 that is arranged at an appropriate position at the upper portion of the post 24, such that the lower portion of the spring 25 can be snapped-in securely together with the flange 241. On the other hand, by changing the shape and the size of the opening 15 arranged at the top end of the cap body 1, the shaking direction and the shaking amplitude of the decoration objects 3 fixed on the elastic element 25 can be controlled effectively. For example, by just arranging one groove 151 (as shown in FIG. 5A) respectively at the front and the rear sides of the opening 15 on the upper portion of the cap body 1, then the decoration objects 3 can only be swung back and forth in a larger amplitude. Similarly, if only one groove 151 is arranged respectively at the left and the right sides of the opening 15 on the upper portion of the cap body 1, then the decoration objects 3 can just be swung left and right in a larger amplitude. On the other hand, if there is no groove 151 arranged specially at the opening 15 of the top end of the cap body 1 (as shown in FIG. 5C), then the decoration objects 3 can be swung freely toward any random direction.

Figure 6:
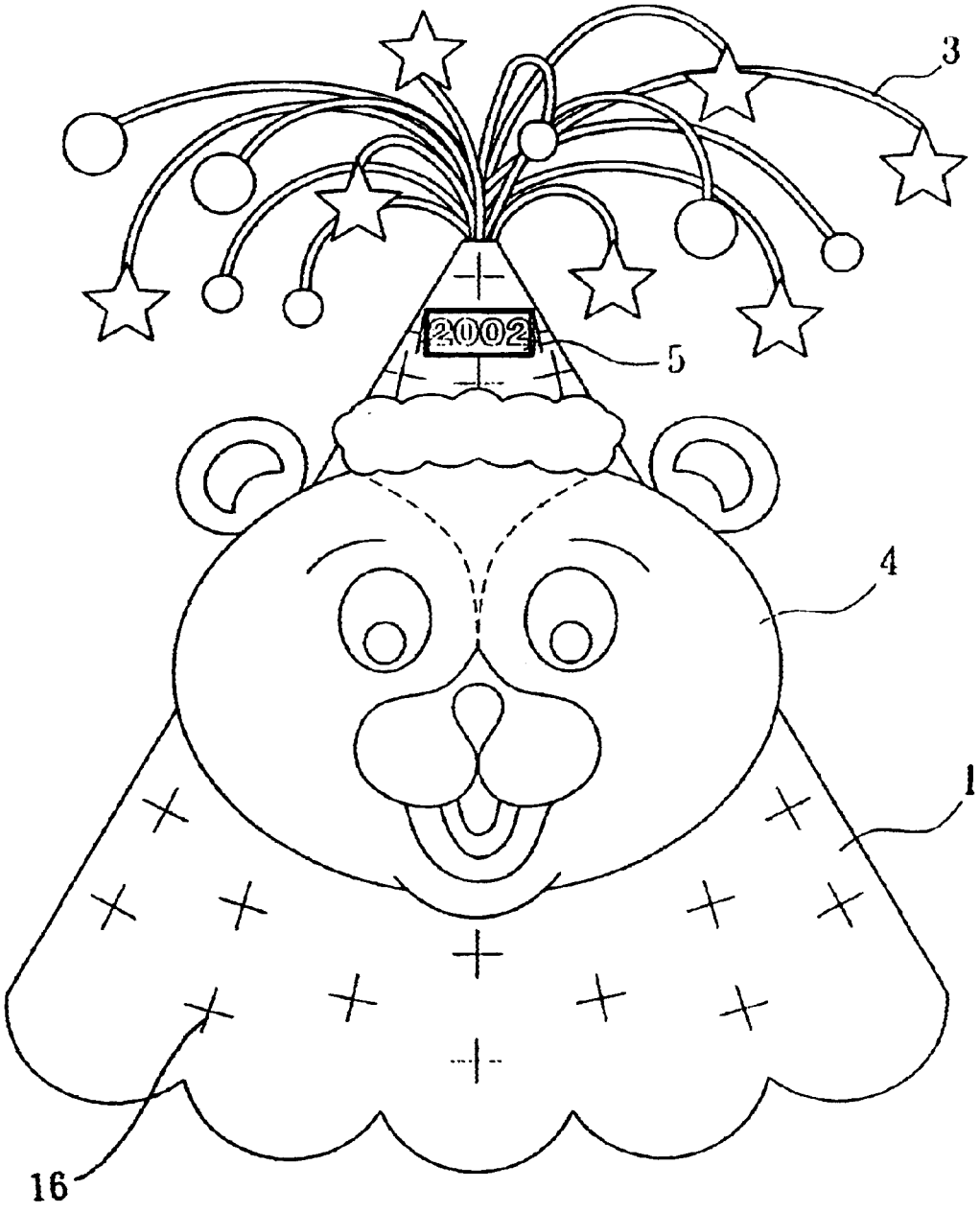
FIG. 6 is an implementing view showing a decorative character atop the cap body of the invention.

Again, in the structure of the invention, there are several cut grooves 16 arranged on the cap body 1, such that the user can directly insert variety of characters 4 or characters 5 into the cut grooves 16 or fix them onto the cap body 1 by a clipping device 6 (as shown in FIG. 6). Thereby, the user can freely pickup the appropriate character 5 or pattern 4 to be fixed on the cap body 1, completely according to his own willingness, the subject of the joining party, or the festival characteristic, etc. Not only does the invention further have the diversification of formative variation, but also can the user completely dominate the design of its outer appearance, such that it has the formation of independent characteristic and further adds the fun and originality.

Figure 7:
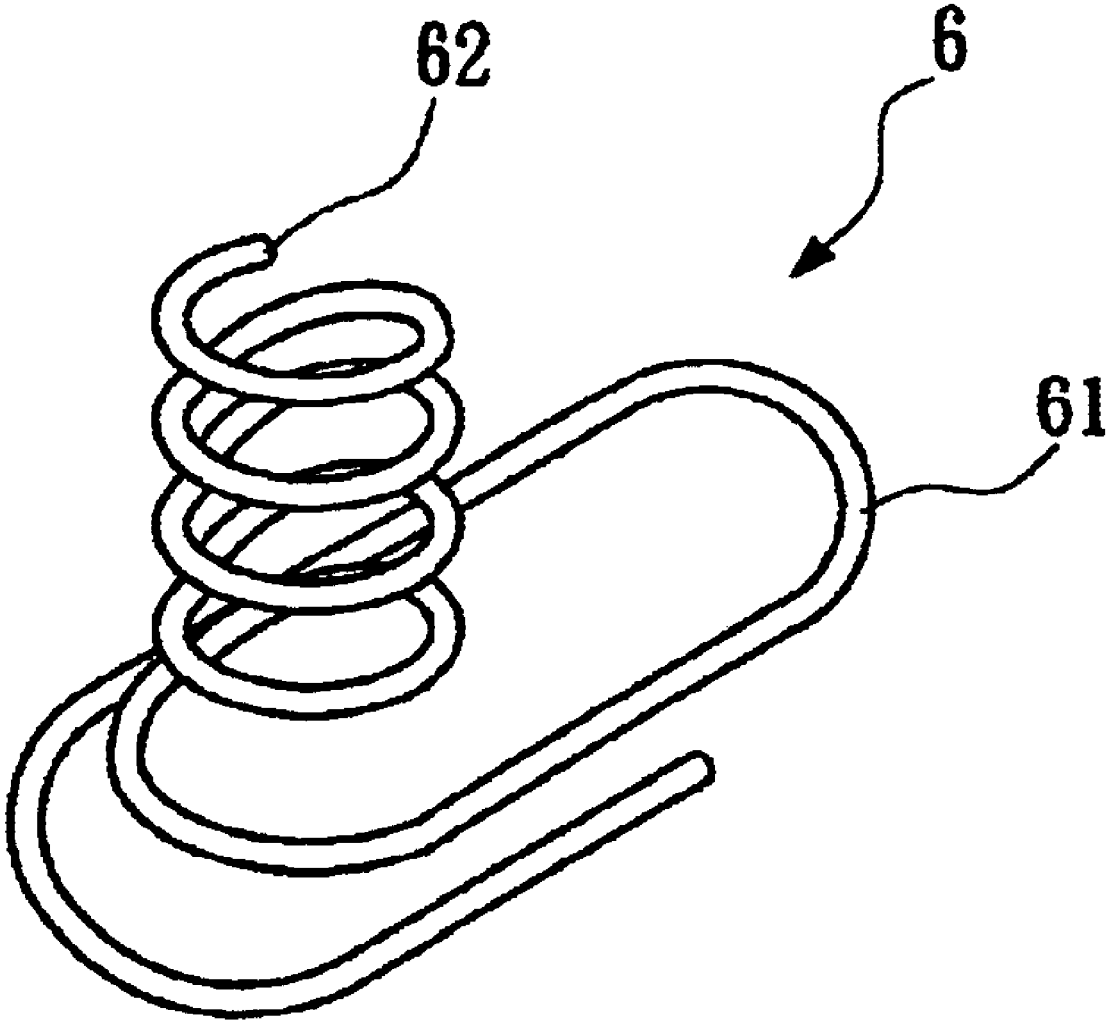
FIG. 7 is an illustration for the outer appearance of the clipping device of the invention.

Further, the said cut groove 16 in the above section is shown as a cut groove having a shape of two perpendicular and intersecting lines, and the clipping device 6 is mainly comprised of a clipping end 61 and an active end 61 (as shown in FIG. 7). Wherein, the clipping end 61 is a structure similar to a paper clip, and the active end 62 is a structure similar to a spring. By fixing the various pattern 4 or character 5 at the end side of the active end 62 of the clipping device 6, the clipping end can be applied to be passed through the cut groove 16 and be fixed on the cap body 1, such that the pattern 4 or character 5 may be generated shake along with the displacement of the user.

Above description are the preferable embodiments according to the invention and the scope covered by the invention is not limited to the embodiments shown in the invention. The generated function and characteristic of any change, made according to the content of the invention (such as: the change of the structure between the supporting seat and the cap body, or the shape variation of the cut groove arranged on the cap body, etc.), similar to the embodiments of the invention as well as those conceivable by the person skilled in such arts are all belonged to the scope covered by the invention.

In sum the foldable formative cap capable of opening automatically according to the invention has the characteristics of simple structure, easy manufacture and assembly. The invention can indeed change the shortcomings of the prior arts; namely, it is unable to be stored foldably or be fixed securely. Compared with the structure of the prior arts, the outer appearance of the product of the invention has the characteristic of DIY design, such that the design of its outer appearance further has the merits of flexibility and interest. Therefore, its application is without doubt, and the invention is not disclosed in any publication or public occasion, and its novelty is out of question to be indeed fulfilled the merits of the new-typed pattern regulated in the pattern law, so this application is proposed according to the regulation of the new-typed pattern. Please your esteem members of reviewing committee take time to review this application in favorable way, and grant it as pattern as soon as possible!

What is claimed is:

1. A foldable formative cap capable of opening automatically comprising: a cap body and a hair hoop, wherein two sides of the cap body have folding lines and are folded, and there is a supporting seat arranged in each of left and right sides of a top face of the hair hoop, an upper portion of the supporting seat is connected and secured at the folding lines at the two sides of the cap body by a fixing structure such that when the supporting seat is propped up by a user, the supporting seat located at the left and right two sides will be closed and tilted toward a center and the distance between the folding lines at the left and the right two sides of the cap body is in turn pulled closer, and the cap body is opened automatically into a three-dimensional shape, wherein the fixing structure for securing the upper portion of the supporting seat and the cap body is a post further arranged at a center of the top face of the hair hoop, and an elastic element is located on an upper portion of the post, an opening is located on a top end of the cap body and decoration objects are arranged on the elastic element, such that said elastic element and the decoration objects thereon extend through the opening arranged on the cap body and are shaken along with a displacement of the body of the user.

2. The foldable formative cap capable of opening automatically according to claim 1, wherein the fixing structure for securing the upper portion of the supporting seat and the cap body is a reverse hook that is located on a top end of the supporting seat and is bent outwardly and reversely, a fixing hole is located on the cap body for the reverse hook to pass through, such that the reverse hook at the upper portion of the supporting seat is passed through the fixing hole on the inner face of the cap body and pulled downward.

3. The foldable formative cap capable of opening automatically according to claim 1, wherein the fixing structure for securing the upper portion of the supporting seat and the cap body is a reverse hook that is located on a top end of the supporting seat and is bent outwardly and reversely, a recessing edge and a protruding part are arranged respectively at the upper portion of the supporting seat and the adjacent face of the tail end of the reverse hook, the cap body has a first fixing hole for the reverse hook to pass through and a second fixing hole for the protruding part to pass through, such that the reverse hook at the upper portion of the supporting seat are passed through the first fixing hole on the inner face of the cap body and pulled down to reach a fixed position, and then the protruding part on the reverse hook is passed through the second fixing hole.

4. The foldable formative cap capable of opening automatically according to claim 1, wherein the fixing structure for securing the upper portion of the supporting seat and the cap body is a clipping part that is located on an upper portion of the supporting seat and is crotched and extended outwardly, a snapping-in recessing edge and a protruding part are arranged respectively at the upper portion of the connecting seat and the adjacent face of the tail end of the clipping part, the cap body has a second fixing hole for the clipping part to pass through and a first fixing hole for the protruding part to pass through, such that the clipping part at the upper portion of the supporting seat are passed through the second fixing hole on the inner face of the cap body to reach a fixed position, and the protruding part arranged on the clipping part is then pressed down, passed through the first fixing hole, and buckled securely together with the snapping-in recessing edge located on the upper portion of the supporting seat.

5. The foldable formative cap capable of opening automatically according to claim 1, wherein the fixing structure for securing the upper portion of the supporting seat and the cap body is a clipping part that is located on an upper portion of the supporting seat and is bent reversely and outwardly, a snapping-in recessing edge is arranged on the supporting seat at the position corresponding to the tail end of the clipping part, the cap body has a first fixing hole and a second fixing hole for the clipping part to pass through, such that the clipping part at the upper portion of the supporting seat is passed through the first fixing hole on the inner face of the cap body to reach a fixed position, and the tail end of the clipping part is pressed down, passed through the second fixing hole, and buckled up securely together with the snapping-in recessing edge arranged at the upper portion of the supporting seat.

6. The foldable formative cap capable of opening automatically according to claim 1, wherein the fixing structure for securing the upper portion of the supporting seat and the cap body is a clipping part that is located on an appropriate position at an upper portion of the supporting seat and is crotched outwardly, the cap body has a first fixing hole for the top end of the supporting seat to pass through and a second fixing hole for the clipping part to pass through, such that the clipping part at the upper portion of the clipping seat is passed through the second fixing hole on the inner face of the cap body and pushed upwardly to reach a fixed position, and the top end of the supporting seat is then made to pass through the first fixing hole.

7. The foldable formative cap capable of opening automatically according to claim 1, wherein the fixing structure for securing the upper portion of the supporting seat and the cap body is a protruding part that is located on the outer side at an appropriate position at the upper portion of the support seat, the cap body has a fixing hole for the protruding part to pass through, the protruding part at the upper portion of the supporting seat is passed through the fixing hole on the inner face of the cap body, and a buckling-up block engages the protruding part.

8. The foldable formative cap capable of opening automatically according to claim 1, wherein the fixing structure for securing the upper portion of the supporting seat and the cap body is a clipping part that is located on the top end of the supporting seat and is bent outwardly and reversely, a buckling-up part is arranged at an appropriate position at the lower portion of the clipping part located on the supporting seat, the cap body has a first fixing hole for the clipping part to pass through and a second fixing hole for the buckling-up part to pass through, such that the clipping part at the upper portion of the supporting seat is passed through the first fixing hole on the inner face of the cap body, pulled downwardly, and then reached to a fixed position, and the buckling-up part arranged on the supporting seat is made to be passed from inside to outside through the second fixing hole arranged on the cap body.

9. The foldable formative cap capable of opening automatically according to claim 1, wherein the elastic element is a spring.

10. The foldable formative cap capable of opening automatically according to claim 9, wherein the fixation manner for the spring and the post is at least one round flange that is arranged at an appropriate position at the upper portion of the post, such that the lower portion of the spring is snapped-in securely together with the flange.

11. The foldable formative cap capable of opening automatically according to claim 1, wherein there are cut grooves are further arranged at the front and rear sides of the opening at the upper portion of the cap body.

12. The foldable formative cap capable of opening automatically according to claim 1, wherein there are cut grooves are further arranged at the left and right sides of the opening at the upper portion of the cap body.

13. The foldable formative cap capable of opening automatically according to claim 1, wherein the cap body has a plurality of cut grooves such that patterns and characters are inserted into the cut grooves and secured therein.

14. The foldable formative cap capable of opening automatically according to claim 13, wherein the structure of the cut groove is shaped as two perpendicular and intersecting lines.

15. The foldable formative cap capable of opening automatically according to claim 1, wherein the cap body has a plurality of cut grooves such that various patterns and characters are connected to the cap body m\by means of a clipping device.

16. The foldable formative cap capable of opening automatically according to claim 15, wherein the structure of the cut groove is shaped as two perpendicular and intersecting lines.

17. The foldable formative cap capable of opening automatically according to claim 15, wherein the clipping device has a clipping end and an active end, wherein the clipping end is a structure similar to a paper clip and the active end is a structure similar to a spring and, by fixing the various pattern or character at the end side of the active end of the clipping device, the clipping end is fixed on the cap body, such that the pattern or character is generated shake along with the displacement of the user.

18. The foldable formative cap capable of opening automatically according to claim 17, wherein the clipping end and the active end of the clipping device are formed integrally.

* * * * *